US006467393B2

(12) United States Patent
Ploog

(10) Patent No.: US 6,467,393 B2
(45) Date of Patent: Oct. 22, 2002

(54) ZEROING DEVICE FOR A HYDROSTATIC PISTON/CYLINDER UNIT

(75) Inventor: Jürgen Ploog, Quarnbek (DE)

(73) Assignee: Sauer-Danfoss, Inc., Ames, IA (US)

( * ) Notice: Subject to any disclaimer, the term of this patent is extended or adjusted under 35 U.S.C. 154(b) by 0 days.

(21) Appl. No.: 09/751,768

(22) Filed: Dec. 29, 2000

(65) Prior Publication Data

US 2001/0006020 A1 Jul. 5, 2001

(30) Foreign Application Priority Data

Jan. 4, 2000 (DE) ..... 100 00 109

(51) Int. Cl.[7] ..... F01B 31/00

(52) U.S. Cl. ..... 92/131; 92/133

(58) Field of Search ..... 92/52, 131, 133, 92/134

(56) References Cited

U.S. PATENT DOCUMENTS 4,669,567 A * 6/1987 Nakamura et al. ..... 92/131

* cited by examiner

*Primary Examiner*—Edward K. Look
*Assistant Examiner*—Thomas E. Lazo

(57) ABSTRACT

A zeroing mechanism for a hydrostatic piston/cylinder unit (1), has an actuating piston (2) that can be moved from a zero position N into at least one deflected position A and can be returned to its zero position N by a zeroing force, the zeroing force being produced at least in part hydraulically.

6 Claims, 4 Drawing Sheets

ZEROING DEVICE FOR A HYDROSTATIC PISTON/CYLINDER UNIT

FIELD OF TECHNOLOGY

The invention pertains to a zeroing device for a hydrostatic piston/cylinder unit with an actuating piston which can be returned to a predetermined zero position from at least one deflected position, in particular for a reversible hydrostat, by means of which opposite swiveling movements can be produced within a closed hydraulic system.

BACKGROUND OF THE INVENTION

Zeroing devices are used, for example, in closed-circuit hydraulic systems when a double-acting hydrostat (hydrostatic linear motor with bilateral pressure actuation) is provided which must be moved back into an initial position from each of its deflected positions, into which it is moved by means of correspondingly unilateral actuation by actuating pressure. The initial position is referred to as a zero position since generally no working medium is delivered in this position.

With such zeroing of hydraulic devices, which is also often referred to as return, it is necessary that the zeroing forces of the zeroing device should be configured in such a way that it can overcome at least the actuating pressures of the main pump of the system at the maximum deflection of the hydrostat and also allows zeroing at maximum working pressures. This is necessary to ensure that the actuating piston of the hydrostat can be returned to its predetermined zero position in any possible working and pressure situation of the system.

A known zeroing device comprises one or more mechanical return springs, which are secured in such a way between the piston and the cylinder of the hydrostat, within the piston, that the piston is moved back automatically from its two deflected positions into its zero position by means of the spring forces. One disadvantage here is that, as the hydrostat swivels out to an increasing extent, the actuating pressures required to swivel out the actuating piston rise owing to increasing spring forces of the return springs. The force required for swiveling out is made up of the zeroing force of the return springs, which must be overcome, and any adjusting forces due to a connected driving mechanism. The actuating pressures must therefore either be increased accordingly or the faces of the actuating piston which are subjected to pressure must be enlarged in order to compensate for the zeroing forces, which thus also increase.

An example of such a known zeroing device with return springs is illustrated in FIG. 1 of the drawing. Here, the return springs are integrated into the actuating piston in order to allow as compact a construction as possible. With increasing deflection of the actuating piston, the actuating pressure in the case of a hydrostat with this mechanical zeroing must be increased. At the same time, the actuating pressure must be increased to match the increased forces due to the increasing spring force. It is thus necessary to operate with higher actuating pressures, for example, and hence with increased outlay on the driving side.

Therefore the principal object of this invention is to provide a zeroing device which allows cost-saving and improved zeroing of hydrostatic piston/cylinder units and has as compact and as space-saving a form as possible.

SUMMARY OF THE INVENTION

In the zeroing device according to the invention, the actuating piston of a piston/cylinder unit can be returned to a predetermined zero position from at least one deflected position within the actuating cylinder. This is accomplished by means of a zeroing force which is produced at least in part hydraulically. As a result, the device has the considerable advantage that a rise in zeroing forces with increasing deflection of the actuating piston, as with the known mechanical return springs, is very largely avoided. Since the zeroing force is produced hydraulically, the required actuating pressures remain essentially the same over the entire deflection of the piston/cylinder unit. With increasing adjustment, the hydraulically produced force increases hardly or not at all even though the zeroing device carries out reliable and controlled zeroing of the piston. Precise zeroing of the actuating piston from any conceivable position and with any occurring forces of the driving mechanism is thus ensured. Overall, this has the advantage that the zeroing device can be of more compact design than hitherto and that the actuating forces required when such a zeroing device is used are lower than with prior-art devices. For example, a piston/cylinder unit of this kind can be made smaller than hitherto since the required faces of the actuating piston can be smaller owing to the lower actuating pressures.

According to one aspect of the invention, the zeroing force is produced hydraulically and mechanically by spring means. This means that zeroing of the actuating piston is assured even in the unpressurized condition. This has the advantage that, although the zeroing force rises slightly with increasing adjustment of the actuating piston away from its zero position, the actuating piston can be adjusted automatically to its zero position without the hydraulic portion of the zeroing force even when the system is unpressurized. The portion of the zeroing force produced mechanically by spring means should at the same time be fixed at such a low level that it is just sufficient to adjust the actuating piston without hydraulic pressure.

According to another aspect of the invention, the feed pressure of a feed pump in a hydraulic system is used to produce the zeroing force. The feed pressure, which is present in any hydraulic circuit in any case and is used to compensate for pressure losses due to leaks and the like, can thus be used for the zeroing device with little additional outlay. As a result, no expensive additional equipment is needed to operate the zeroing device.

According to another aspect of the invention, a zeroing piston is provided, and is connected firmly to the actuating cylinder to interact hydraulically with the actuating piston in such a way that the actuating piston is moved into its zero position when a zeroing pressure is supplied. When the zeroing piston is subjected to pressure, the actuating piston of the piston/cylinder unit is thus adjusted to its initial position. The zeroing piston is arranged within the actuating piston and is connected to the actuating cylinder by a piston rod. A cylindrical tube is formed within the actuating piston to accommodate the zeroing piston, thus avoiding impairment or enlargement of the hydrostat concerned. The zeroing device is integrated completely and in a space-saving manner into the actuating piston. One resulting advantage is the compact construction of the zeroing device and of the entire hydrostat. Corresponding opposite pressure lines or feed openings are provided in the actuating piston and in the actuating cylinder for the purpose of feeding the zeroing pressure into the interior of the actuating piston. In this case, the lines and openings are designed in such a way that the zeroing pressure can be fed in at any time, despite the relative motion of the actuating piston and the actuating cylinder. This can be achieved, for example, by means of an opening in the actuating cylinder which is widened at the end in the axial direction of the actuating piston or by means of corresponding longitudinal grooves.

According to another aspect of the invention, a return spring with a matching spring constant is provided to zero the actuating piston in the unpressurized condition. Zeroing is thus assured even if the pressure in the hydraulic system—and hence in the piston/cylinder unit—drops or there is no feed pressure. The spring force of this spring is, of course, much lower than that of the return springs described at the outset in prior-art devices since, when zeroing in the unpressurized condition, all that has to be overcome are frictional forces between the actuating piston and its cylinder.

According to another aspect of the invention, the zero position of the actuating piston is adjustable. Adjustment or readjustment is advantageous because it allows the position of the actuating piston in the zero position to be changed subsequently and, if necessary, adjusted after a long period of operation.

According to another aspect of the invention, the faces of the zeroing piston are matched to a maximum zeroing force required. In this way, the zeroing device can be matched structurally to the use and the areas of application of the hydrostat. If the maximum pressure conditions are low, a correspondingly small piston-face size can be calculated to give an adequate zeroing function. The zeroing pressure is, as an alternative, matched to a maximum zeroing force required in the hydraulic system. This makes it possible to adapt the zeroing device for different maximum pressure conditions by means of the variable zeroing pressure.

DESCRIPTION OF THE PREFERRED EMBODIMENT

Figure 1:
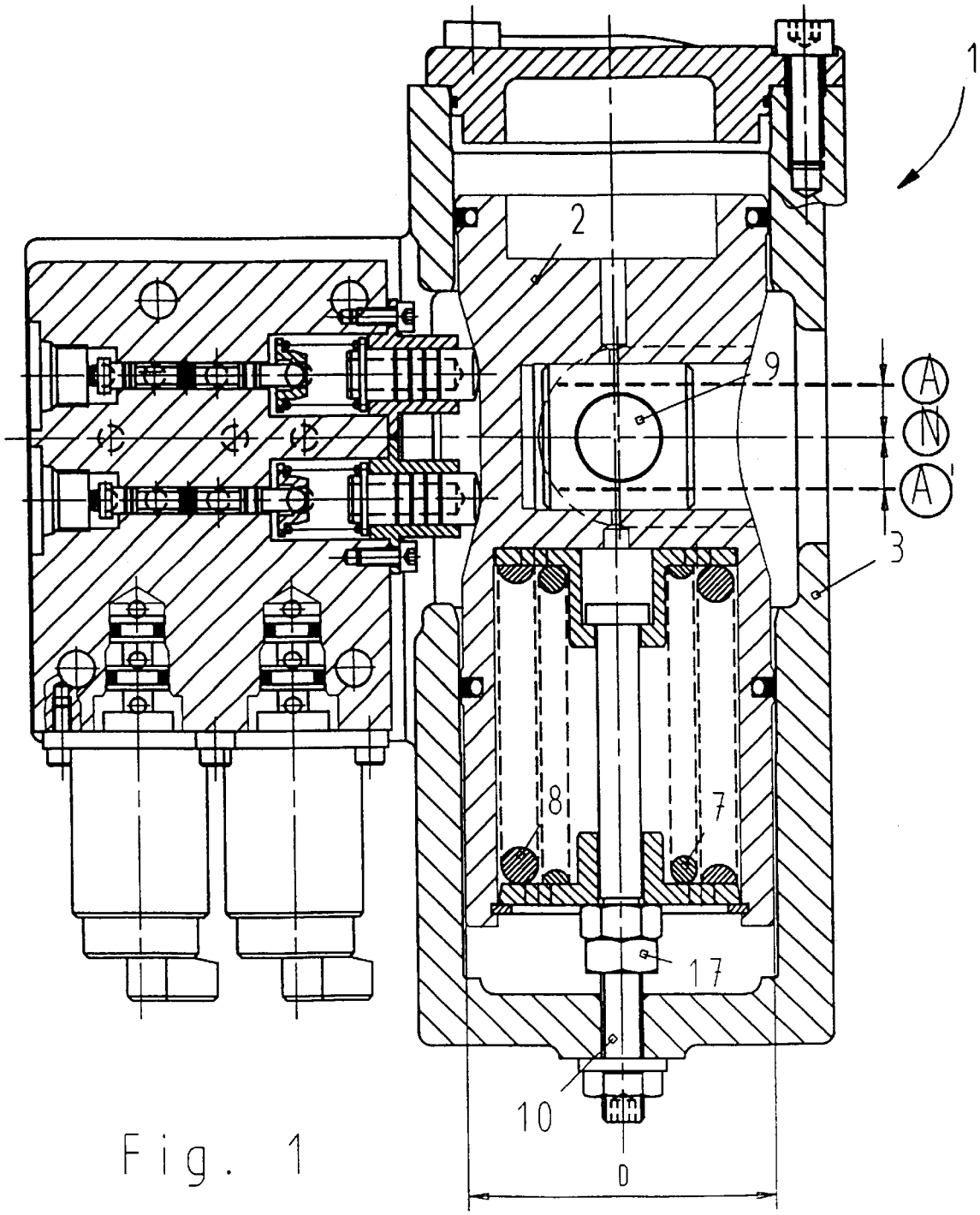
Fig. 1 PRIOR ART
FIG. 1 shows a sectioned plan view of a piston/cylinder unit with mechanical zeroing in accordance with the prior art.

FIG. 1 illustrates a prior-art zeroing device, in which the zeroing force is produced by purely mechanical means. The piston/cylinder unit 1 comprises the actuating piston 2, which can be deflected in the actuating cylinder 3 in both axial directions from its zero position N, illustrated in the drawing, into respective deflected positions A, A'. For this purpose a piston face of an actuating piston 2 with the diameter D is subjected to an actuating pressure. The actuating piston furthermore has a pivotal connection 9, by means of which the deflection is transmitted to a swashplate to be actuated. Two helical compression springs are installed as zeroing springs 7, 8 in the interior of the actuating piston 2, these springs moving the actuating piston 2 back into its zero position N from its deflected positions A, A'. The pressure forces are transmitted to the actuating piston 2 by a rod 10 screwed to the actuating cylinder 3. This is an example of known zeroing devices which have previously been used in conjunction with hydrostats.

Figure 2:
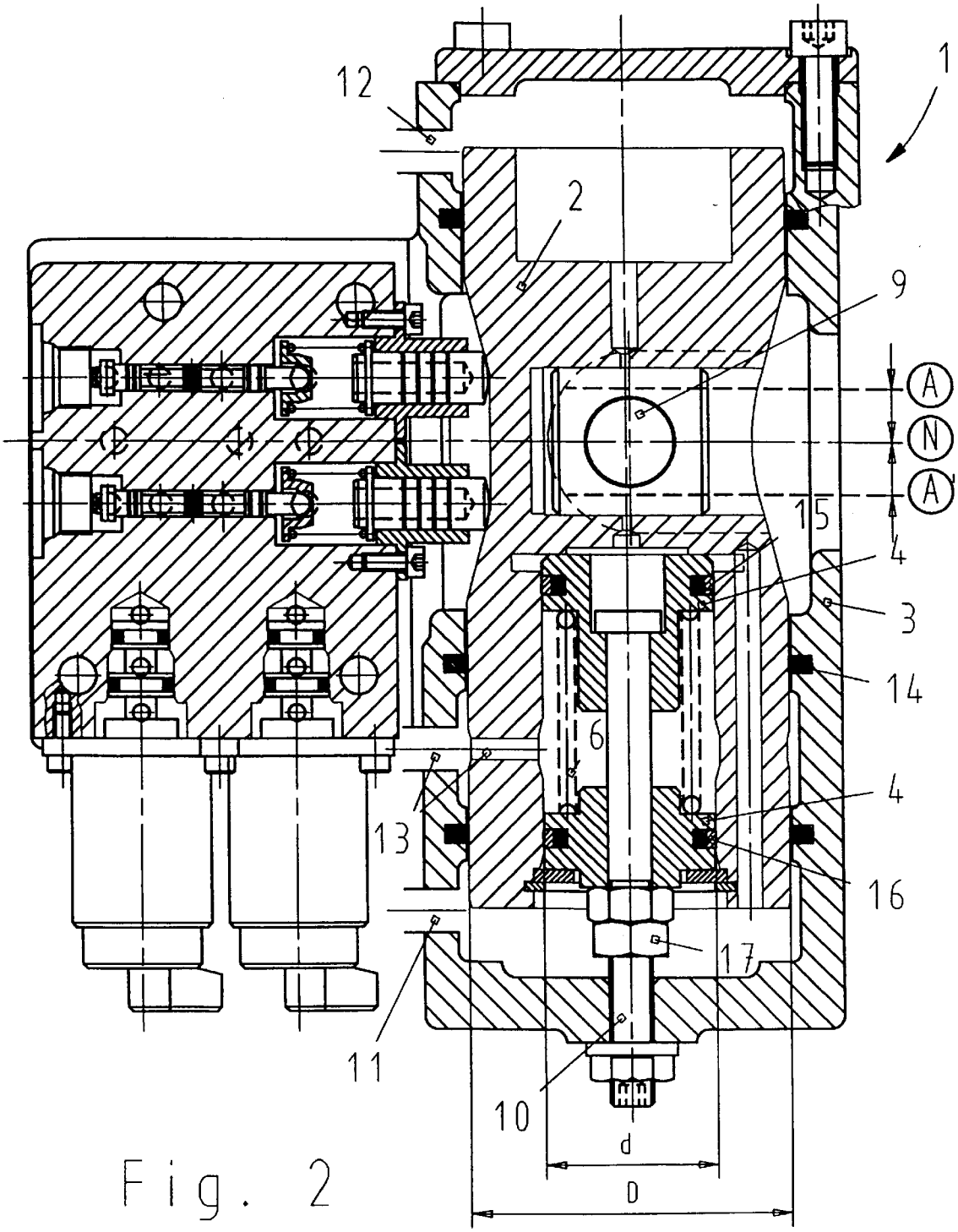
FIG. 2 shows a sectioned plan view of a piston/cylinder unit with mechanical/hydraulic zeroing in accordance with the invention in the zero position.

FIG. 2 shows a plan view, in section, of a piston/cylinder unit, which corresponds essentially to that in FIG. 1, this being a zeroing device according to the invention. The actuating cylinder 2 is shown in its centered zero position N. If an actuating pressure is fed to the piston via the feed lines 11, 12, it moves into its respective deflected position A, A', but in this case it is moved back from this position by means of a hydraulic zeroing force. For this purpose, zeroing pistons 4 are provided within the actuating piston 2, these being actuated by a hydraulic zeroing pressure. For this purpose, lateral openings 13 are provided in the actuating piston 2 and in the actuating cylinder 3 and, via these opening, a zeroing pressure is passed into the interior of the actuating piston, by connecting up the feed pump, for example. The zeroing pistons 4 are mounted displaceably on a rod 10. The actuating piston 2 is moved into its zero position N by the interaction of the rod 10 of the zeroing pistons 4 with the piston faces, of diameter d, of the zeroing piston 4. The zeroing piston 4 is preloaded by a return spring 6, which is designed as a helical compression spring and serves to zero the actuating piston 2 in the unpressurized condition. Accordingly, the return spring 6 has only a low spring force. However, the main part of the zeroing force is produced hydraulically in order as far as possible to avoid a rise in the zeroing force with increasing deflection (in this regard, see also FIGS. 4*a* and 4*b*). Provided between the zeroing piston 4 and the actuating piston 2 and between the actuating piston 2 and the actuating cylinder 3 are sealing elements 14, 15, 16, which serve to separate the pressure zones from the hydrostat 1 and the zeroing device. At its cylinder-side fastening end, the rod 10 of the zeroing piston 4 has a threaded portion with adjusting nuts 17 and lock nuts, by means of which the zero position N of the actuating piston 2 can be adjusted.

Figure 3:
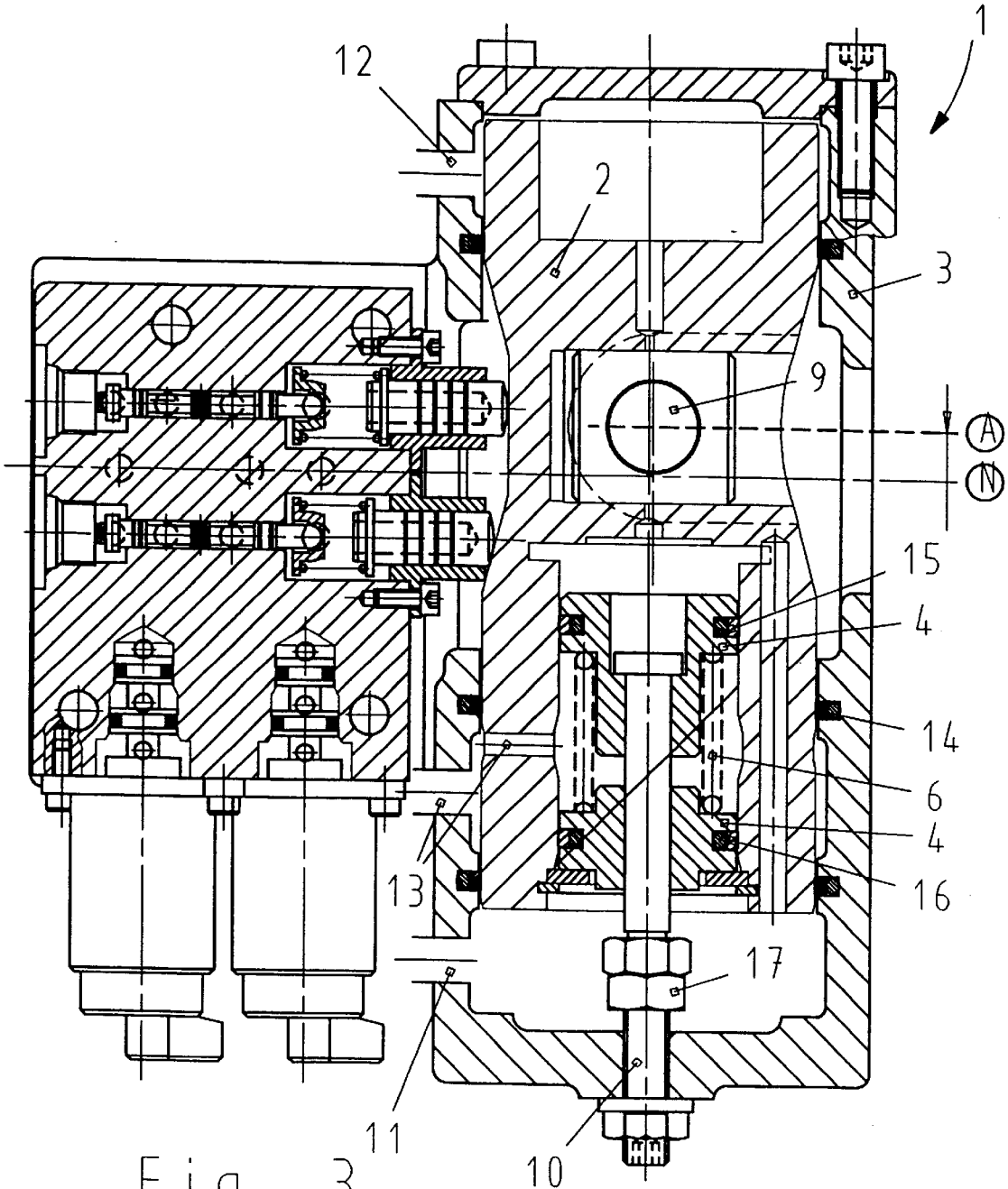
FIG. 3 shows a sectioned plan view of the piston/cylinder unit in FIG. 2 in a deflected position.

FIG. 3 shows the piston/cylinder unit from FIG. 2 in the deflected position A before the zeroing device is actuated. Although the feed lines 13 for feeding the zeroing pressure to the zeroing cylinder 4 are offset relative to one another, pressure can be fed to the zeroing piston 4 via the opening 13 on the inside of the actuating cylinder 3, said opening being extended to form a longitudinal groove or circumferential groove. In other respects, the statements made with reference to FIG. 2 apply here accordingly.

Figure 4A:
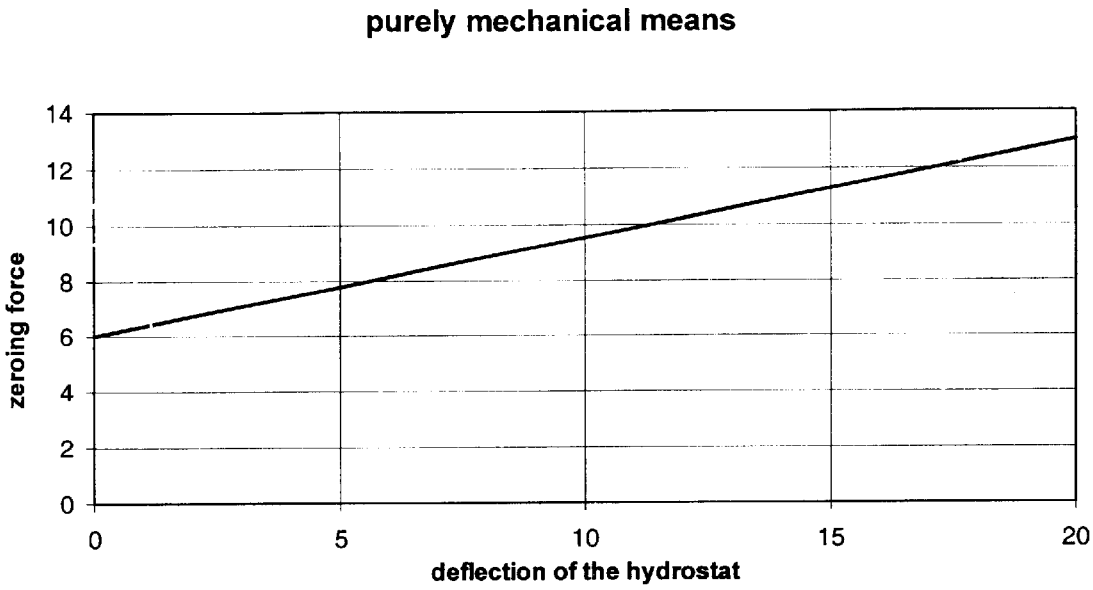
FIGS. 4*a,* 4*b* show two diagrams to illustrate the difference between a mechanically produced zeroing force and a hydraulically produced zeroing force.
Figure 4B:
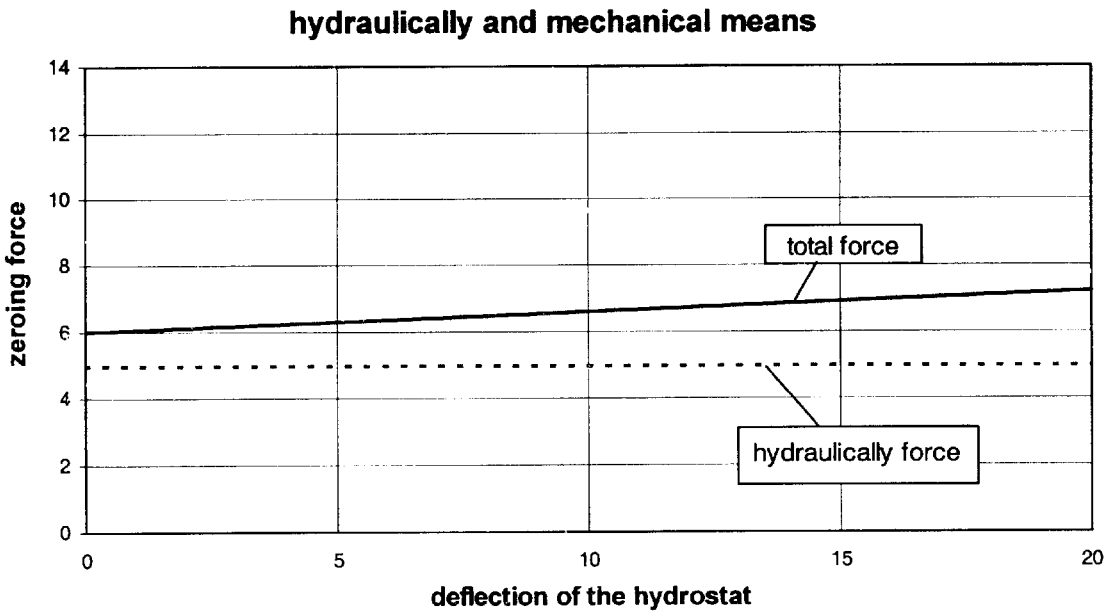

From the two diagrams in FIGS. 4*a* and 4*b* it is clear how the zeroing force in a zeroing device according to the invention is made up in an advantageous manner compared with a zeroing force produced by purely mechanical means. Whereas, in the case of a zeroing force (ordinate in FIG. 4*a*) produced purely mechanically using conventional zeroing springs, this force increases significantly as the deflection of the hydrostat increases (FIG. 4*a* abscissa), the zeroing force in the zeroing system in accordance with the invention remains approximately the same, even in the case of a large deflection (FIG. 4*b*). Only the very small force contribution of the return spring for unpressurized zeroing causes a slight increase in the zeroing force. It is thus clearly apparent that a significant advantage of the invention lies in reducing the zeroing force required.

What is claimed is:

1. A zeroing device for a hydrostatic piston/cylinder unit (1) with a double-acting actuating piston (2), comprising, means on the device for returning the piston to a predetermined zero position (N) from at least one deflected position (A) within an actuating cylinder (3) by means of a zeroing force from a power means, wherein the zeroing force is produced at least in part hydraulically, the zero position of the actuating piston (2) being adjustable.

2. The zero device as claimed in claim 1, wherein the zeroing force is produced hydraulically and mechanically by spring means.

3. The zeroing device as claimed in claim 1, wherein the zeroing force is produced by the feed pressure of a feed pump in a hydraulic system.

4. The zeroing device of claim 1, wherein a return spring (6) is provided to zero the actuating piston (2) in an unpressurized condition.

5. A zeroing device for a hydrostatic piston/cylinder unit (1) with a double-acting actuating piston (2), comprising, means on the device for returning the piston to a predetermined zero position (N) from at least one deflected position (A) within an actuating cylinder (3) by means of a zeroing force from the power means, wherein the zeroing force can be produced at least in part hydraulically, zeroing pistons being provided and being displaceable on a rod (10) which is connected firmly to the actuating cylinder (3) to interact hydraulically with the actuating piston (2) such that the actuating piston (2) is moved into the zero position when a zeroing pressure is supplied, and wherein the zeroing piston (4) is integrated into the actuating piston (2) and is connected to the actuating cylinder (3) by a rod (10).

6. The zeroing device of claim 5, wherein pressure lines for the zeroing pressure are provided in the actuating piston (2) and in the actuating cylinder (3).

* * * * *